US008193854B2

(12) United States Patent
Kuang et al.

(10) Patent No.: US 8,193,854 B2
(45) Date of Patent: Jun. 5, 2012

(54) BI-DIRECTIONAL TRIMMING METHODS AND CIRCUITS FOR A PRECISE BAND-GAP REFERENCE

(75) Inventors: Xiao Fei Kuang, Hangzhou (CN); Kam Chuen Wan, Hong Kong (HK); Kwai Chi Chan, Hong Kong (HK); Yat To (William) Wong, Hong Kong (HK); Kwok Kuen (David) Kwong, Davis, CA (US)

(73) Assignee: Hong Kong Applied Science and Technology Research Institute Company, Ltd., Hong Kong (HK)

( * ) Notice: Subject to any disclaimer, the term of this patent is extended or adjusted under 35 U.S.C. 154(b) by 294 days.

(21) Appl. No.: 12/651,993

(22) Filed: Jan. 4, 2010

(65) Prior Publication Data

US 2011/0163799 A1 Jul. 7, 2011

(51) Int. Cl.
*G05F 3/02* (2006.01)

(52) U.S. Cl. ..... 327/539; 323/312

(58) Field of Classification Search ..... None
See application file for complete search history.

(56) References Cited

U.S. PATENT DOCUMENTS

| | | | | |
|---|---|---|---|---|
| 4,412,241 | A | 10/1983 | Nelson | |
| 5,325,045 | A | 6/1994 | Sundby | |
| 6,218,822 | B1 * | 4/2001 | MacQuigg | 323/313 |
| 6,949,971 | B2 * | 9/2005 | Jang | 327/541 |
| 7,230,473 | B2 * | 6/2007 | Tadeparthy et al. | 327/539 |
| 7,453,252 | B1 * | 11/2008 | Megaw | 323/313 |
| 7,538,597 | B2 * | 5/2009 | Kwong et al. | 327/525 |
| 7,633,333 | B2 * | 12/2009 | Ma | 327/539 |
| 7,688,054 | B2 * | 3/2010 | Cave | 323/313 |
| 7,880,459 | B2 * | 2/2011 | Harvey | 323/313 |
| 7,920,011 | B1 * | 4/2011 | Tseng | 327/309 |
| 8,022,751 | B2 * | 9/2011 | Le et al. | 327/539 |
| 2001/0011886 | A1 * | 8/2001 | Kobayashi | 323/281 |
| 2002/0030526 | A1 * | 3/2002 | McClure et al. | 327/308 |
| 2004/0245975 | A1 * | 12/2004 | Tran et al. | 323/313 |
| 2004/0245977 | A1 * | 12/2004 | Tran | 323/315 |
| 2007/0052473 | A1 * | 3/2007 | McLeod | 327/539 |
| 2007/0126495 | A1 * | 6/2007 | Ivanov et al. | 327/539 |
| 2007/0252573 | A1 * | 11/2007 | Tachibana et al. | 323/313 |

* cited by examiner

*Primary Examiner* — Cassandra Cox
(74) *Attorney, Agent, or Firm* — Stuart T Auvinen; g Patent LLC

(57) ABSTRACT

A bandgap reference circuit has trimming-up resistors and trimming-down resistors for bi-directional trimming. PNP transistors have base and collectors grounded and emitters connected to parallel resistors. A difference resistor drives an inverting input of an op amp that drives a transistor that generates the bandgap reference voltage Vbg. A sensing resistor connects Vbg to a splitting node that connects to the non-inverting input through a first parallel resistor. The splitting node also connects through a second parallel resistor to the inverting input. Fuses or switches enable the trimming-up and trimming-down resistors. The trimming-up resistors are in series with the sensing resistor and the trimming-down resistors are in series with an output resistor that connects Vbg to reference voltage Vref. The circuit can be designed for a more typical process since bi-directional trimming allows Vref to be raised or lowered. Many circuits need no trimming when targeted for the typical process.

20 Claims, 11 Drawing Sheets

BI-DIRECTIONAL TRIMMING METHODS AND CIRCUITS FOR A PRECISE BAND-GAP REFERENCE

FIELD OF THE INVENTION

This invention relates to bandgap reference circuits, and more particularly to bi-directional trimming circuits for bandgap references.

BACKGROUND OF THE INVENTION

Bandgap reference circuits are commonly used to generate a stable reference voltage from the silicon bandgap. Bandgap reference generator circuits may be used in DC-DC converters, Analog-to-Digital Converters (ADC), low dropout drivers, and many other kinds of analog circuits.

The base-to-emitter voltage Vbe in a PNP transistor, shown in equation EQN1, $$V_{be} = V_T \ln \frac{I_c}{A * J_s}, \qquad \text{EQN 1}$$

where $V_T$ is thermal voltage, A is the emitter-base junction area, and Js is the current density. The base-emitter voltage Vbe is relatively constant because a large collector current Ic variation only causes a small Vbe variation. A pair of ratioed PNP transistors can be used to sink current in a voltage divider network that generates the reference voltage. A feedback loop can be included with an op amp that has compare inputs tapped from nodes within the voltage divider network. Many variations of this basic circuit are in use.

The basic bandgap reference circuit creates a reference voltage that is independent of temperature, supply voltage, and process variations. However, the feedback loop can introduce an offset that does vary with the process. These process variations can be compensated for by trimming the resistance value of a resistor in the voltage divider network.

After the circuit is fabricated, a test probe is dropped onto a pad on the voltage reference node or another related node. The reference voltage is measured using the test probe. The resistance value is trimmed or adjusted by blowing fuses or trimming resistors with a laser, programming registers that control the resistance value, or by some other method. The reference voltage is measured again, and the resistance value again adjusted. Several iterations may be used to fine-tune the reference voltage by successively trimming smaller resistance values.

While trimming is useful, it is difficult to precisely tune the resistance value. The reference voltage may be overshot without any way to compensate when permanent fuses are blown. Trimming is often one-dimensional, either increasing or decreasing the reference voltage.

What is desired is a bi-directional trimming circuit for a bandgap reference circuit. A reference circuit that can trim the reference voltage both up and down is desired.

DETAILED DESCRIPTION

The present invention relates to an improvement in trimable bandgap reference circuits. The following description is presented to enable one of ordinary skill in the art to make and use the invention as provided in the context of a particular application and its requirements. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

Figure 1:
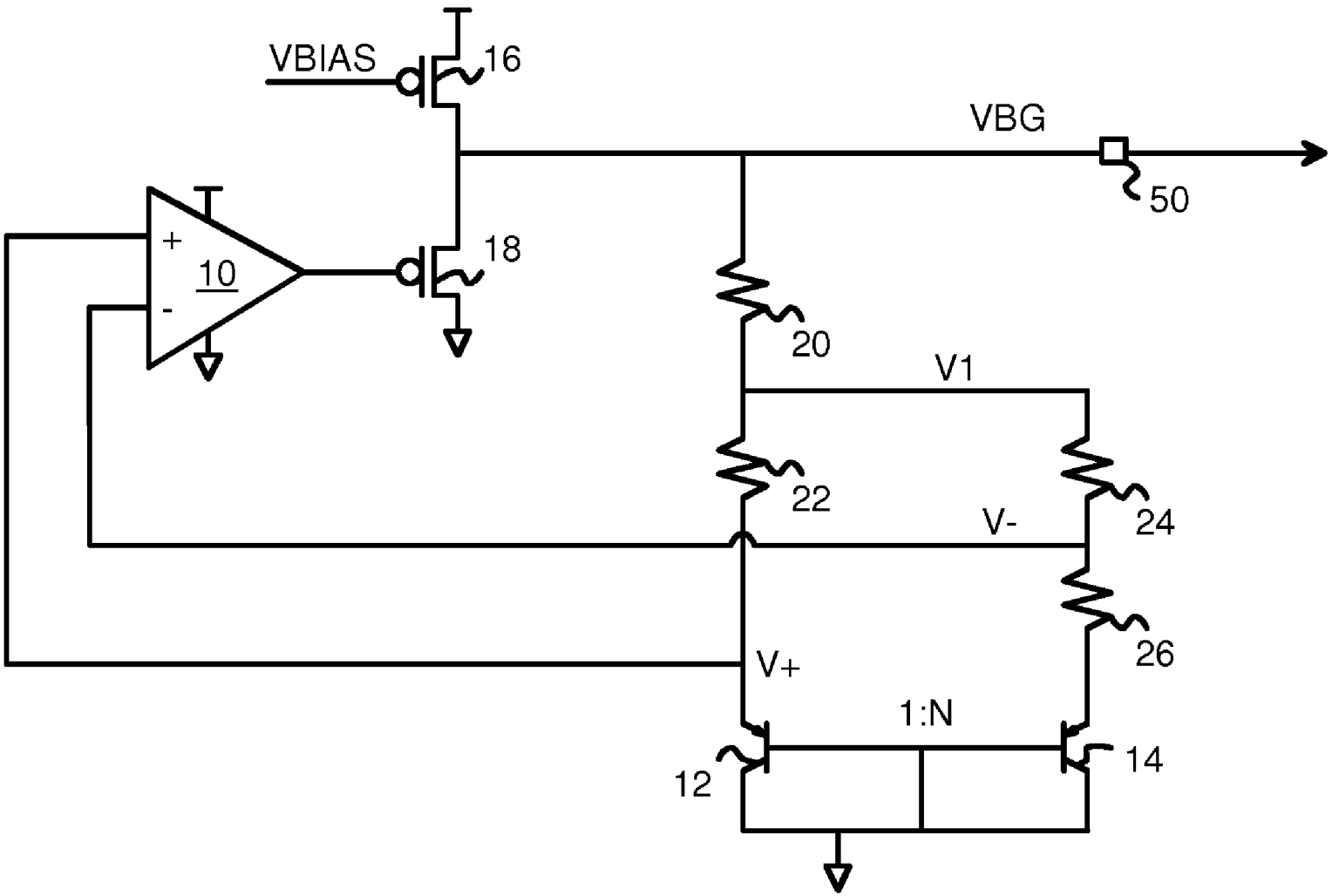
FIG. 1 is a block diagram of a bandgap reference circuit.

FIG. 1 is a block diagram of a bandgap reference circuit. PNP transistors 12, 14 have their collectors and their bases tied to ground. PNP transistor 14 is N times larger than PNP transistor 12, and thus sinks about N times more collector current under the same bias conditions.

A bandgap reference voltage Vbg is generated by p-channel bias transistor 16, which has its gate driven by a bias voltage Vbias, and has its source connected to the power supply, and by p-channel generating transistor 18, which has its drain grounded and its gate driven by the output of op amp 10. Op amp 10 has differential inputs receiving nodes V+, V−. Node V+ is the emitter of PNP transistor 12, while node V− is generated between parallel resistor 24 and difference resistor 26.

A voltage divider network is connected between Vbg and PNP transistors 12, 14. Sensing resistor 20 is connected between Vbg and node V1. Current is split at node V1. One branch of current passes from node V1 through parallel resistor 22 to node V+ and PNP transistor 12, while the other branch of current passes from node V1 through parallel resistor 24 to node V−, then through difference resistor 26 to the emitter of PNP transistor 14.

When Vbg rises above is set point, more current flows through the voltage divider network due to the higher Vbg. In particular, more current flows through sensing resistor 20, raising V1. More current also flows in both branches. The higher current flow through difference resistor 26 raises V− relative to V+, since the emitter voltages of both of PNP transistors 12, 14 remains near Vbe, which is very stable.

The higher V− applied to the inverting input of op amp 10 causes the output of op amp 10 to fall in voltage. The lower voltage output by op amp 10 to the gate of p-channel generating transistor 18 increases current flow through p-channel generating transistor 18. Thus higher current through p-channel generating transistor 18 pulls Vbg to a lower voltage, thus compensating for the initial rise in Vbg.

A similar but opposite feedback occurs when Vbg falls in voltage, causing op amp 10 to compensate and raise Vbg. Thus Vbg is a stable reference voltage. The voltage of Vbg can be probed by touching Vbg probe pad 50 with a mechanical probe and measuring the probe's voltage.

The bandgap voltage Vbg, can be calculated using the following equation:

$$V_{bg} = V_{be1} + \left[\frac{2R_1 + R_2}{R_3}\right] \times \ln N \times V_T \qquad \text{EQN 2}$$

where R1 is the resistance of sensing resistor 20, R2 is the resistance of both parallel resistors 22, 24, which have equal resistances, and R3 is the resistance of difference resistor 26. Vbe1 is the base-emitter voltage of PNP transistor 12, N is the ratio of emitter areas of PNP transistors 14, 12, and $V_T$ is thermal voltage.

Figure 2:
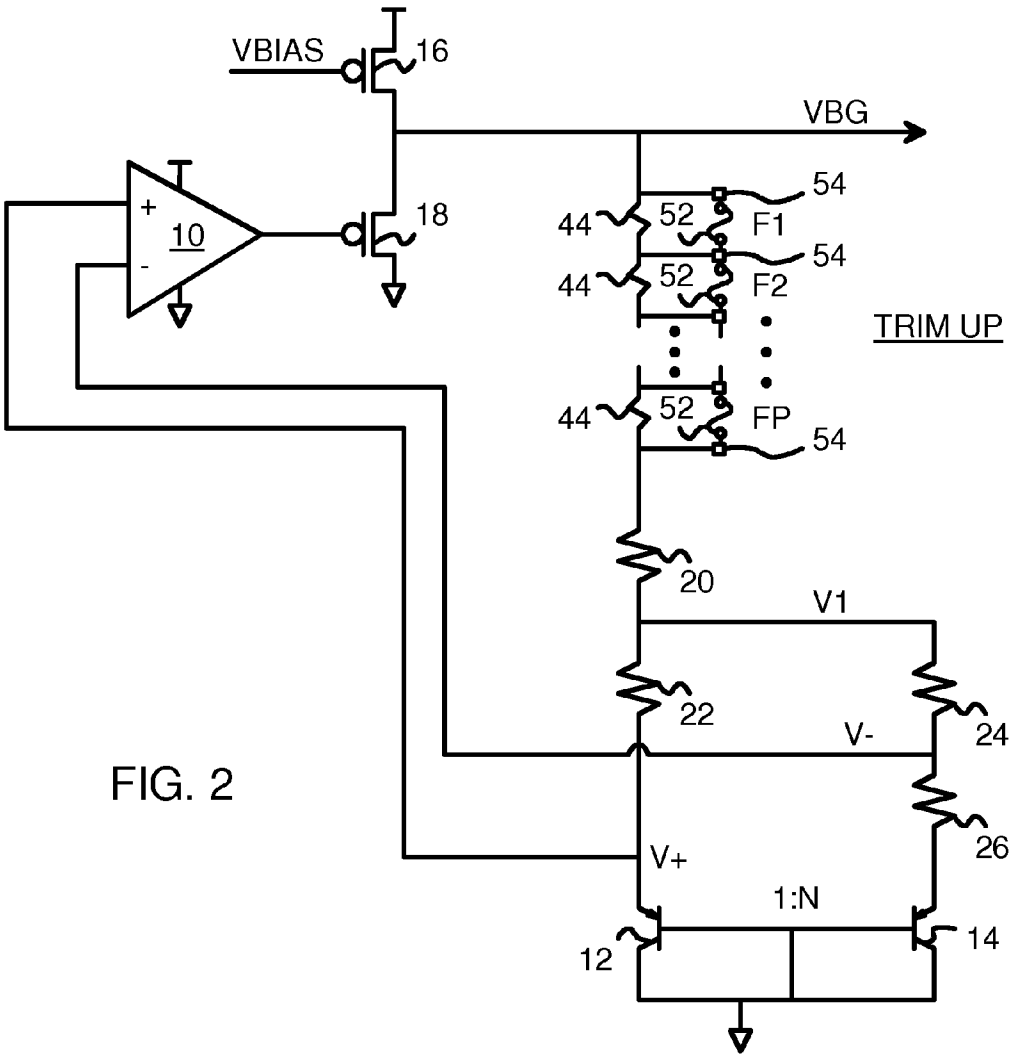
FIG. 2 is a bandgap reference circuit with trimming-up resistors.

FIG. 2 is a bandgap reference circuit with trimming-up resistors. FIG. 2 operates in a similar fashion to the circuit of FIG. 1. However, R1 now includes sensing resistor 20 and trimming-up resistors 44 in series.

Each of trimming-up resistors 44 has a fuse 52 in parallel. Fuse 52 is between pads 54. Probes can be applied to pads 54 around fuse 52, and a high current flowed through the probes to melt or otherwise blow fuse 52. Once fuse 52 is blown, the trimming-up resistor 44 in parallel with that fuse 52 is now in series with sensing resistor 20, and its resistance is added to R1 in EQN2.

When none of fuses 52 is blown, R1 is equal to the resistance of sensing resistor 20. When multiple fuses 52 are blown, R1 is the sum of the resistance of sensing resistor 20 and all trimming-up resistors 44 that are in parallel with blown fuses 52.

The resistance values of trimming-up resistors 44 can be binary-weighted. For example, fuse F1 enables resistance R, fuse F2 enables resistance 2*R, fuse F3 enables resistance 4*R, . . . fuse FP enables resistance $2^{(P-1)}$*R.

The trimmed resistance value R1 can be increased as more and more fuses 52 are blown. The larger R1 increases Vbg as EQN2 shows. However, there is no way to lower Vbg, since fuses can only be blown open, not shorted once blown open. Thus trimming-up resistors 44 are useful for raising Vbg, or trimming up. A total of P+1 trimming pads 54 are needed for P fuses 52 and P trimming-up resistors 44.

Figure 3:
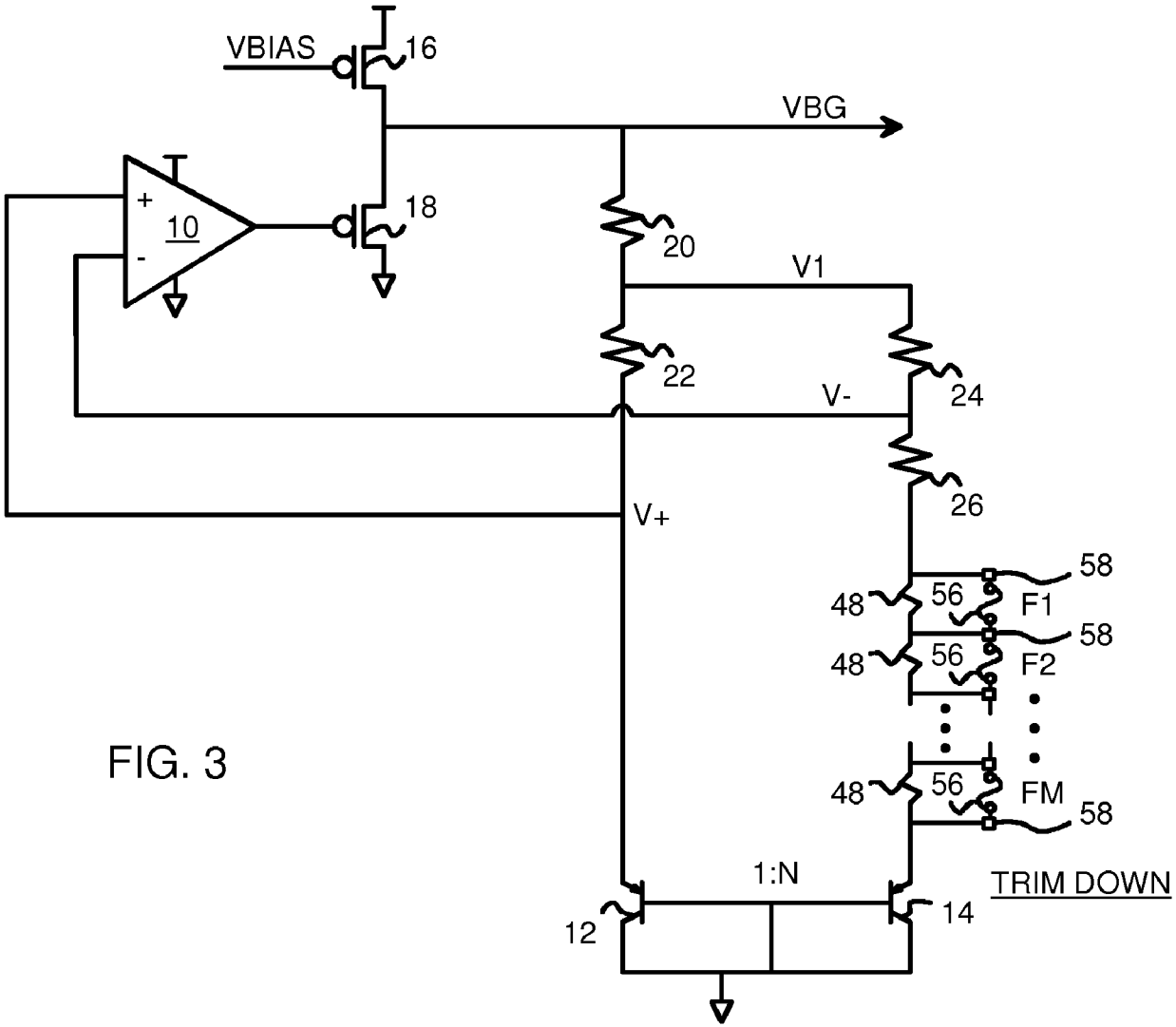
FIG. 3 is a bandgap reference circuit with trimming-down resistors.

FIG. 3 is a bandgap reference circuit with trimming-down resistors. FIG. 3 operates in a similar fashion to the circuit of FIG. 1. However, R3 now includes difference resistor 26 and trimming-down resistors 48 in series.

Each of trimming-down resistors 48 has a fuse 56 in parallel. Fuse 56 is between pads 58. Probes can be applied to pads 58 around fuse 56, and a high current flowed through the probes to melt or otherwise blow fuse 56. Once fuse 56 is blown, the trimming-down resistor 48 in parallel with that fuse 56 is now in series with difference resistor 26, and its resistance is added to R3 in EQN2.

When none of fuses 56 is blown, R3 is equal to the resistance of difference resistor 26. When multiple fuses 56 are blown, R3 is the sum of the resistance of difference resistor 26 and all trimming-down resistors 48 that are in parallel with blown fuses 56.

The resistance values of trimming-down resistors 48 can be binary-weighted. For example, fuse F1 enables resistance R, fuse F2 enables resistance 2*R, fuse F3 enables resistance 4*R, . . . fuse FM enables resistance $2^{(M-1)}$*R.

The trimmed resistance value R3 can be increased as more and more fuses 56 are blown. The larger R3 decreases Vbg as EQN2 shows. However, there is no way to raise Vbg, since fuses can only be blown open, not shorted once blown open. Thus trimming-down resistors 48 are useful for lowering Vbg, or trimming down. A total of M+1 trimming pads 58 are needed for M fuses 56 and M trimming-down resistors 48. Vbg probe pad 50 is also needed, while in FIG. 2 Vbg probe pad 50 can be shared with the top-most pad 54. Thus trimming down requires one more pad. Pads can be large in area, such as 50 microns (μ)×50 microns, and thus expensive.

Figure 4:
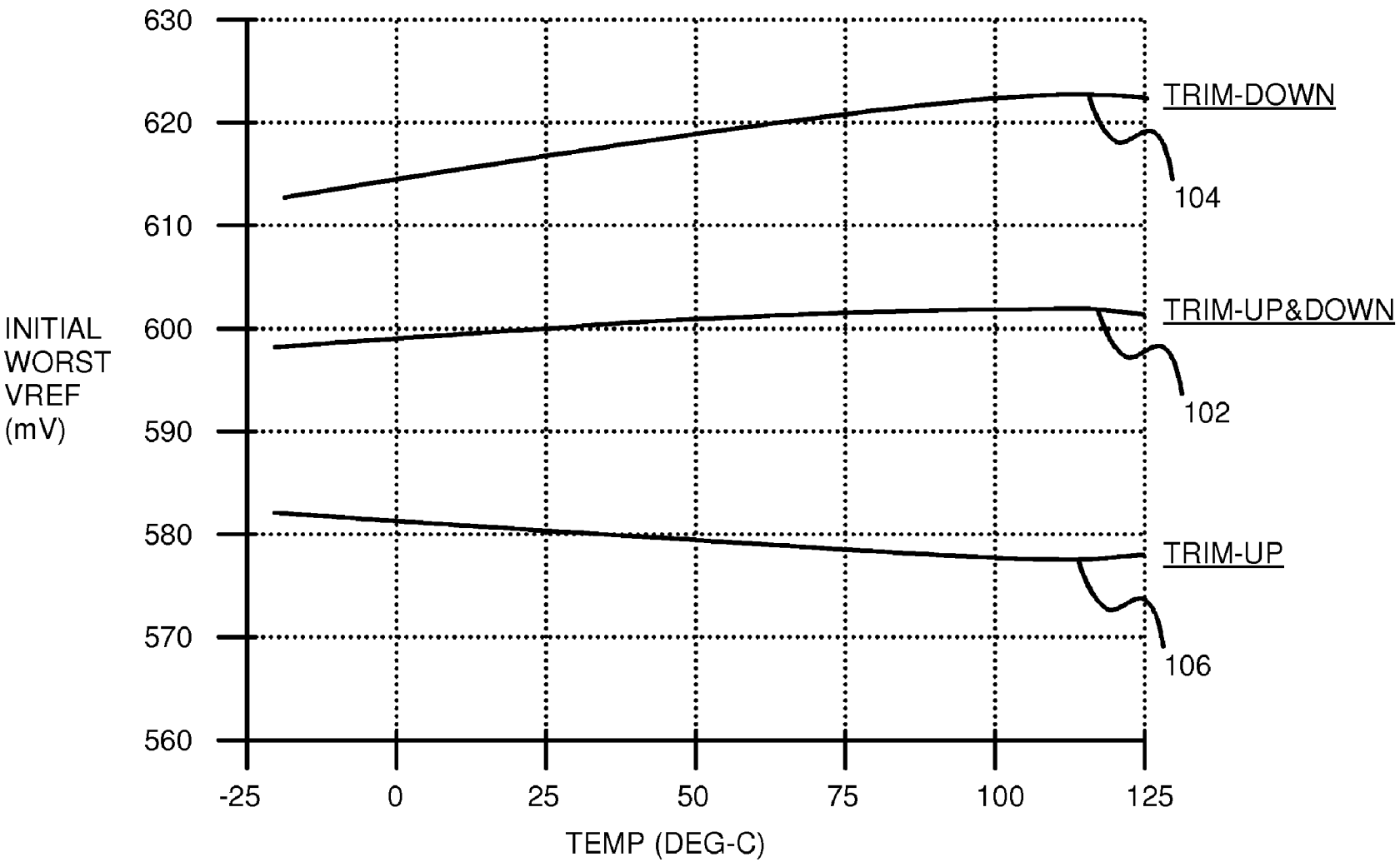
FIG. 4 is a graph of initial values of Vref for trimming up and trimming down.

FIG. 4 is a graph of initial values of Vbg for trimming up and trimming down. The initial value of Vbg must be set high when trimming-down is used, since Vbg can never be raised. The initial value of Vbg may be determined by a worst-case simulation of temperature, supply voltage, and process variations that affect the offset of the driver stage, p-channel bias transistor 16 and p-channel generating transistor 18.

Figure 5:
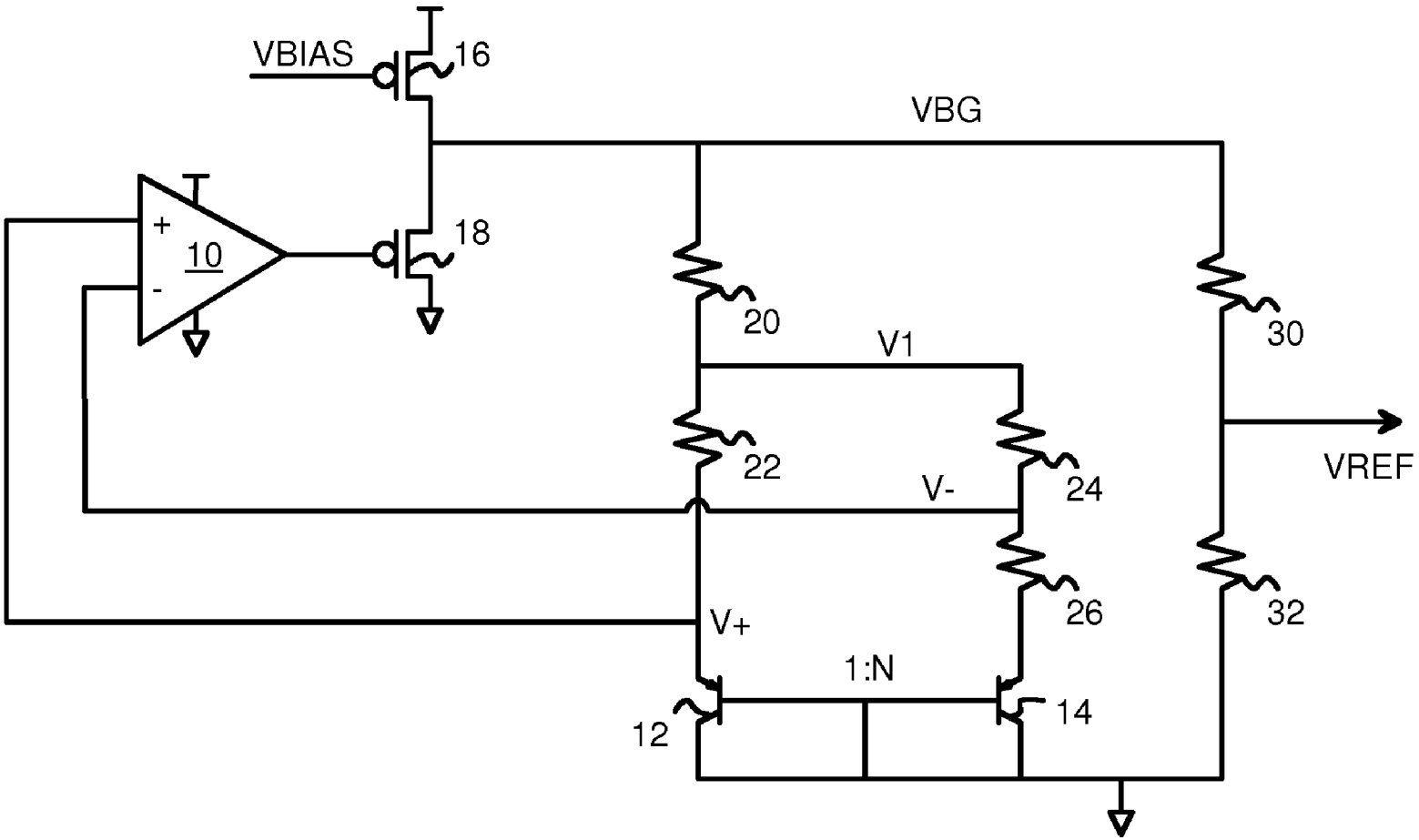
FIG. 5 is a bandgap reference circuit with an output Vref.

When only trimming-up is available, such as the circuit of FIG. 2, curve 106 shows the initial value of Vref for worst-case conditions as a function of temperature. Vref can be generated from Vbg as shown in FIG. 5. Curve 106 is very low, since Vref can never be trimmed lower than the initial value.

When only trimming-down is available, such as the circuit of FIG. 3, curve 104 shows the initial value of Vref for worst-case conditions as a function of temperature. Curve 104 is very high, since Vref can never be trimmed above the initial value.

Figure 6:
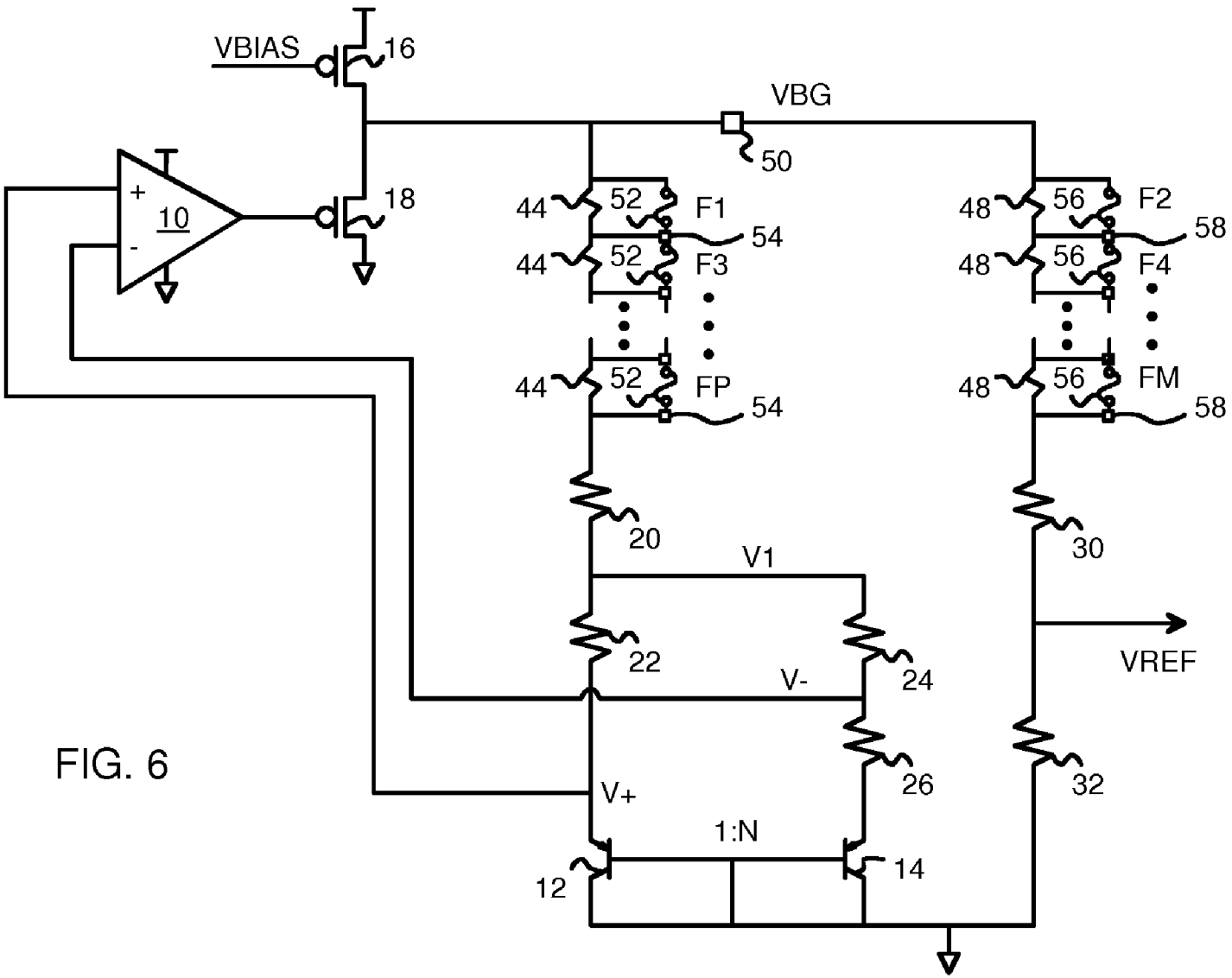
FIG. 6 is a bandgap reference circuit with both trimming-up and trimming-down.

Both curves 104, 106 are undesirable. However, when both trimming-up and trimming-down are incorporated into the same circuit, such as shown in FIG. 6, the initial value of Vref can be closer to the target value. Vref can be trimmed both above and below the initial value. A much improved circuit can be realized, and better values of resistances chosen. Curve 102 shows the initial values of Vref when both trimming-up and trimming-down are available.

Test time is reduced, since some circuits do not need any trimming at all, such as when process conditions match the design values. Since process variations are typically a Gaussian distribution, the initial value of Vref can be chosen to correspond to the peak of the Gaussian distribution of process variations. Targeting the initial resistances values and Vref to match the process conditions at the Gaussian peak can result in many circuits not needing any trimming at all. Only process outlier circuits need trimming.

Trimming time can be further reduce since both up and down trimming are available. If the target is overshot, trimming can be performed in the opposite direction. Less caution needs to be exercised when blowing fuses. This can result in faster trimming times.

The temperature coefficients of curves 104, 106 are poor, as their slopes show. In contrast, the temperature coefficient of curve 102 is good, as shown by its relatively flat slope. When the circuit operates over a given range of temperatures, a lower variation of Vref is achieved with curve 102 than with curves 104, 106; thus the bi-directional trimming Vref has a better temperature coefficient.

FIG. 5 is a bandgap reference circuit with an output reference voltage Vref. The circuit of FIG. 5 is similar to the circuit of FIG. 1 and operates in a similar manner. However, output resistor 30 generates Vref from Vbg. Sink resistor 32 sinks current from Vref. Vref can be lower in voltage than Vbg, which is desirable in some applications. Vref is related to Vbg by the equation:

$$\text{Vref}=\text{Vbg}*(R5/(R4+R5)) \qquad \text{EQN3}$$

where R4 is the resistance of output resistor 30 and R5 is the resistance of Sink resistor 32.

FIG. 6 is a bandgap reference circuit with both trimming-up and trimming-down. The circuit of FIG. 6 is similar to the circuit of FIG. 5 and FIG. 1 and operates in a similar manner. R1 includes sensing resistor 20 and trimming-up resistors 44 in series. R4 includes output resistor 30 and trimming-down resistors 48 in series.

Each of trimming-up resistors 44 has a fuse 52 in parallel between pads 54. Probes can be applied to pads 54 around fuse 52, and a high current flowed through the probes to melt or otherwise blow fuse 52. Once fuse 52 is blown, the trimming-up resistor 44 in parallel with that fuse 52 is now in series with sensing resistor 20, and its resistance is added to R1 in EQN2.

When none of fuses 52 is blown, R1 is equal to the resistance of sensing resistor 20. When multiple fuses 52 are blown, R1 is the sum of the resistance of sensing resistor 20 and all trimming-up resistors 44 that are in parallel with blown fuses 52.

The resistance values of trimming-up resistors 44 can be binary-weighted. For example, fuse F1 enables resistance R, fuse F3 enables resistance 2*R, fuse F5 enables resistance 4*R, . . . fuse FP enables resistance $2^{(P-1)}$*R.

The trimmed resistance value R1 can be increased as more and more fuses 52 are blown. The larger R1 increases Vbg as EQN2 shows, and the larger Vbg increases Vref as EQN3 shows.

Trimming-down resistors 48 are in series with output resistor 30. Each of trimming-down resistors 48 has a fuse 56 in parallel. Fuse 56 is between pads 58. Probes can be applied to pads 58 around fuse 56, and a high current flowed through the probes to melt or otherwise blow fuse 56. Once fuse 56 is blown, the trimming-down resistor 48 in parallel with that fuse 56 is now in series with difference resistor 26, and its resistance is added to R4 in EQN3.

When none of fuses 56 is blown, R4 is equal to the resistance of output resistor 30. When multiple fuses 56 are blown, R4 is the sum of the resistance of output resistor 30 and all trimming-down resistors 48 that are in parallel with blown fuses 56.

The resistance values of trimming-down resistors 48 can be binary-weighted. For example, fuse F2 enables resistance R, fuse F4 enables resistance 2*R, fuse F6 enables resistance 4*R, . . . fuse FM enables resistance $2^{(M-1)}$*R.

The trimmed resistance value R4 can be increased as more and more fuses 56 are blown. The larger R4 decreases Vref as EQN3 shows. Thus Vref can be increased (trimmed up) by blowing additional fuses 52, and Vref can be decreased (trimmed down) by blowing additional fuses 56. Trimming is bi-directional.

Vbg probe pad 50 can be shared for use in blowing both the top F1 trimming-up fuse 52 and the top F2 trimming-down fuse 56. A total of P trimming pads 54 are needed for P fuses 52 and P trimming-up resistors 44, plus a total of M trimming pads 58 for M fuses 56 and M trimming-down resistors 48. The total pads needed are P+M+1.

Figure 7:
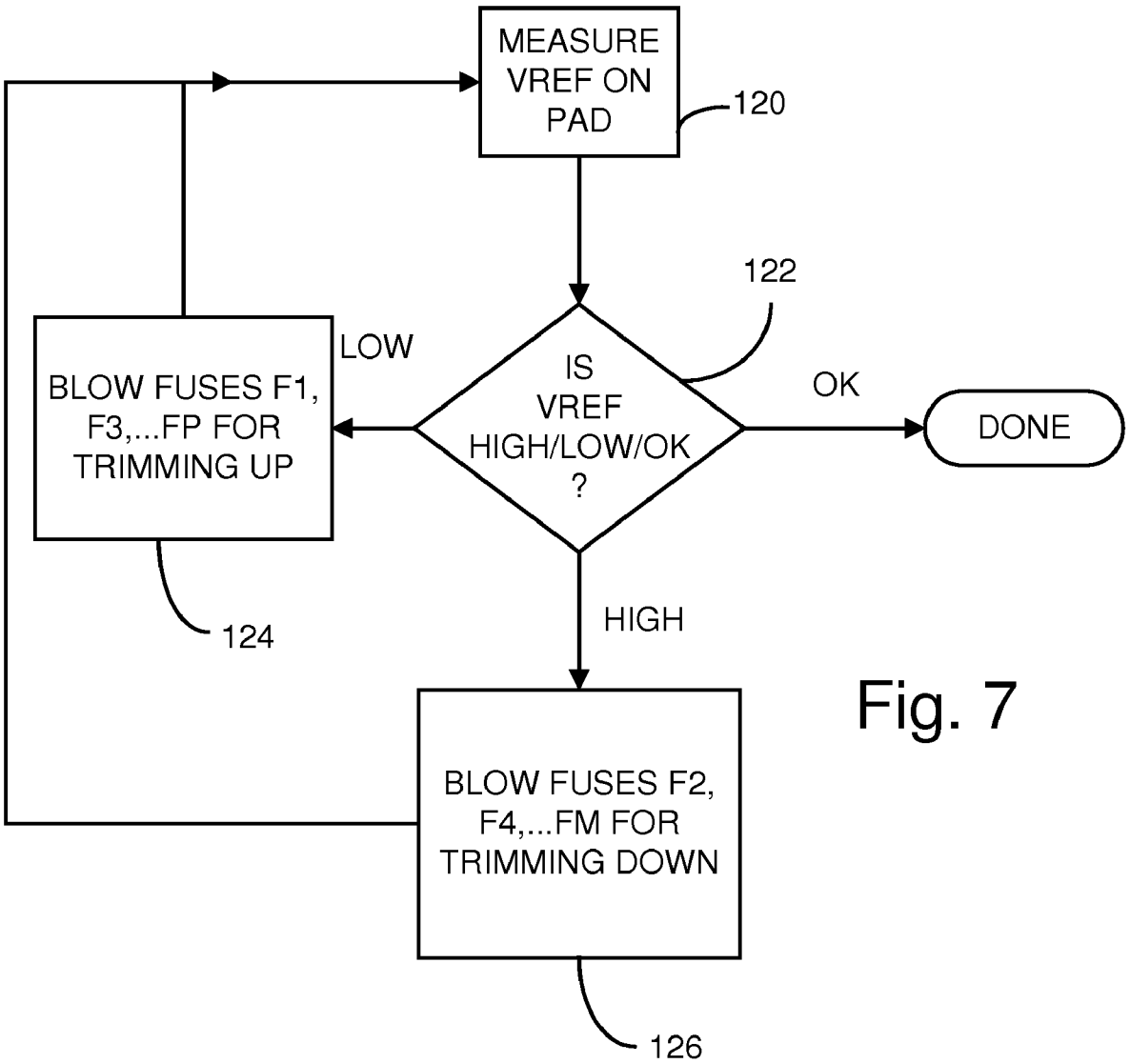
FIG. 7 is a flowchart of a bi-directional trimming process.

FIG. 7 is a flowchart of a bi-directional trimming process. The circuit of FIG. 6 can be trimmed using the process of FIG. 7. After fabrication, the circuit is tested, either in wafer form or after die separation and packaging, or at both times. A probe is dropped on a probe pad on Vref, and Vref is measured, step 120. The measured Vref is compared to a target Vref, or a target range for Vref, step 122. When the measured Vref is within a target range of Vref values, step 122, then trimming is completed. The circuit does not need any further trimming. This event is expected to be common since the initial worst Vref can be designed for the typical process, rather than a worst-case process as is needed for circuits that only trim in one direction.

When the measured Vref is below the target range, step 122, then one or more fuses parallel to trimming-up resistors 44 are blown, step 124. This increases R1, Vbg, and Vref. The measuring process can be repeated iteratively with step 120.

When the measured Vref is above the target range, step 122, then one or more fuses parallel to trimming-down resistors 48 are blown, step 126. This increases R4 and Vref, although Vbg is not changed. The measuring process can be repeated iteratively with step 120. Note that both trimming up and trimming down can be performed on the same circuit when multiple iterations of FIG. 7 are performed. Successively smaller resistance values can be chosen for successive iterations.

Figure 8:
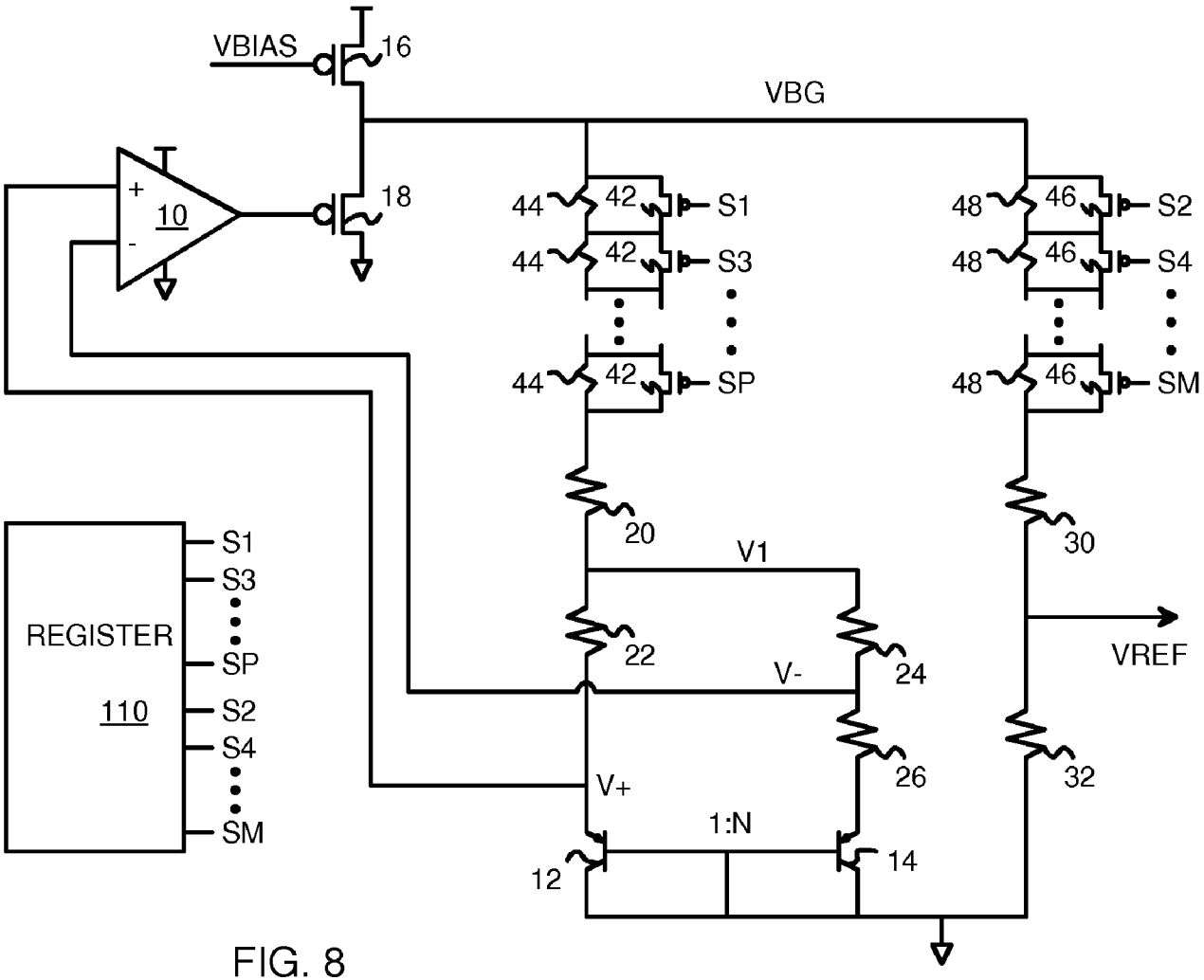
FIG. 8 is a bandgap reference circuit with digital switches for both trimming-up and trimming-down.

FIG. 8 is a bandgap reference circuit with digital switches for both trimming-up and trimming-down. The circuit of FIG. 8 is similar to the circuit of FIGS. 6, 4, and 1 and operates in a similar manner. However, rather than have fuses 52, 56, p-channel transistor switches are used. Fuses 52 are replaced by switches 42, which are in parallel with trimming-up resistors 44. The gates of p-channel transistors in switches 42 are activated to conduct when register 110 outputs a low voltage (logic zero) and to isolate when register 110 outputs a high voltage (logic 1), emulating a blown fuse.

Register 110 is initially loaded with all zeros (0000), which causes switches 42, 46 to conduct and bypass trimming-up resistors 44 and trimming-down resistors 48. During up-trimming, the digital value stored in register 110 is altered, causing some of select signals S1, S3, . . . SP to go high. The high select signal turns off one of switches 42, forcing current through one of trimming-up resistors 44, increasing resistance R1, Vbg, and Vref. Likewise, during down-trimming, the digital value stored in register 110 is altered, causing some of select signals S2, S4, . . . SM to go high. The high select signal turns off one of switches 46, forcing current through one of trimming-down resistors 48, increasing resistance R3 and Vref.

The digital value in register 110 can change so that some select signals change from high back to low. Unlike fuses 52 which are permanently blown, switches 42, 46 can toggle back and forth between on and off states during trimming. Thus trimming is more flexible using switches 42, 46.

Register 110 can hold two binary values that drive select signals to binary-weighed trimming-up resistors 44 and trimming-down resistors 48. Probe pads are not needed between switches 42, 46, since fuses are not blown. Instead, only one pad (not shown) is needed for Vref.

The trimmed resistance value R1 can be increased as more and more switches 42 are turned off. The larger R1 increases Vref as EQN2 shows. The trimmed resistance value R4 can be increased as more and more switches 46 are turned off. The larger R4 decreases Vref as EQN3 shows. Thus Vref can be increased (trimmed up) by opening additional switches 42, and Vref can be decreased (trimmed down) by opening additional switches 46. Trimming is bi-directional.

Figure 9:
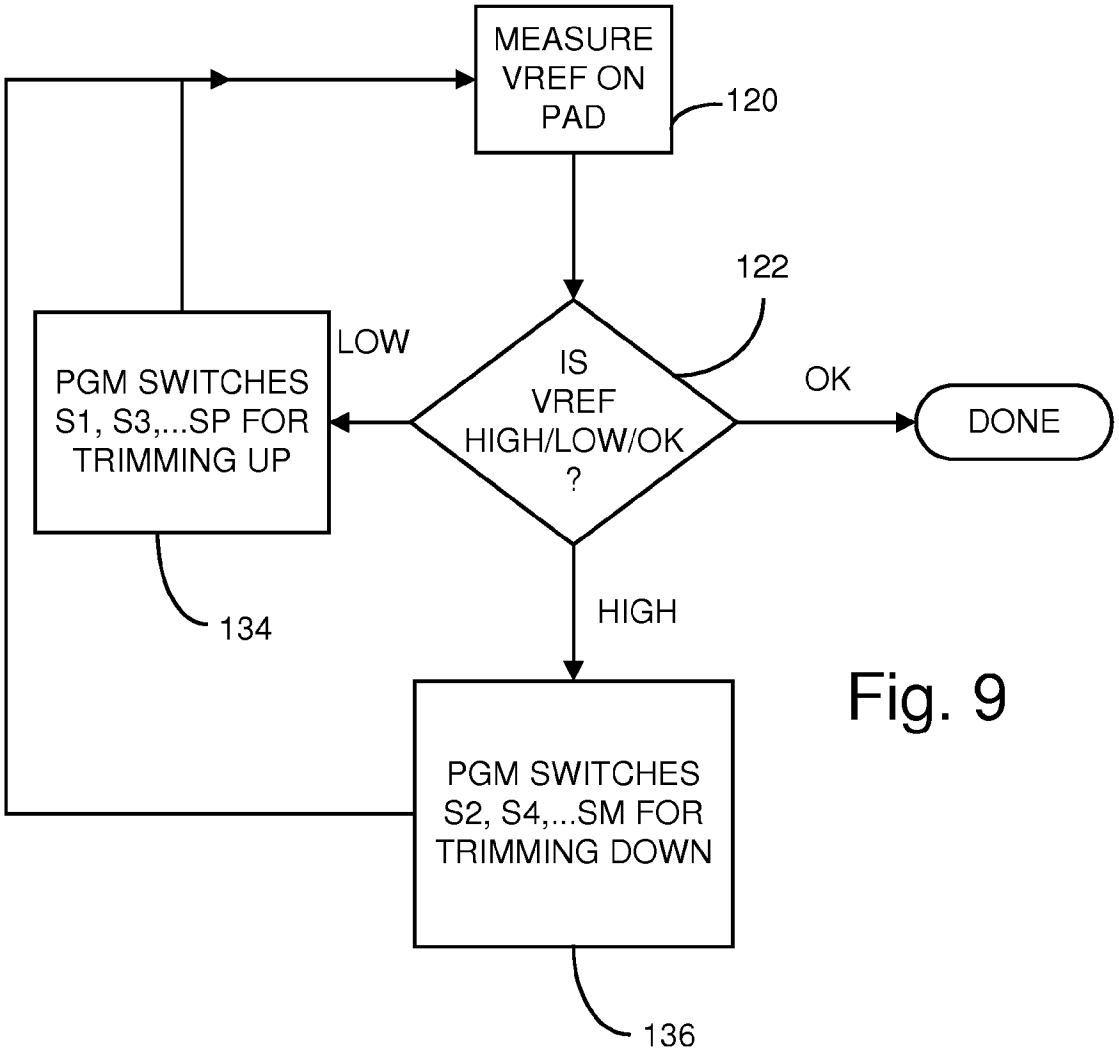
FIG. 9 is a flowchart of a bi-directional trimming process using digital switches rather than fuses.

FIG. 9 is a flowchart of a bi-directional trimming process using digital switches rather than fuses. The circuit of FIG. 8 can be trimmed using the process of FIG. 9. After fabrication, the circuit is tested, either in wafer form or after die separation and packaging, or at both times. A probe is dropped on a probe pad on Vref, and Vref is measured, step 120. The initial values in register 110 are all zeros.

The measured Vref is compared to a target Vref, or a target range for Vref, step 122. When the measured Vref is within a target range of Vref values, step 122, then trimming is completed. The circuit does not need any further trimming. This event is expected to be common since the initial worst Vref can be designed for the typical process, rather than a worst-case process as is needed for circuits that only trim in one direction.

When the measured Vref is below the target range, step 122, then one or more switches 42 parallel to trimming-up resistors 44 are opened by driving logic 1 onto their gates, step 134. This increases R1, Vbg, and Vref. The measuring process can be repeated iteratively with step 120, with the digital values stored in register 110 changed. For example, a sequencer or state machine or other logic could drive the value into register 110, or a program being executed could load new values into register 110.

When the measured Vref is above the target range, step 122, then one or more switches 46 parallel to trimming-down resistors 48 are opened by driving logic 1 onto their gates, step 126. This increases R4 and Vref, although Vbg is not changed. The measuring process can be repeated iteratively with step 120. Note that both trimming up and trimming down can be performed on the same circuit when multiple iterations of FIG. 7 are performed. Successively smaller resistance values using higher digital values in register 110 can be chosen for successive iterations.

Figure 10:
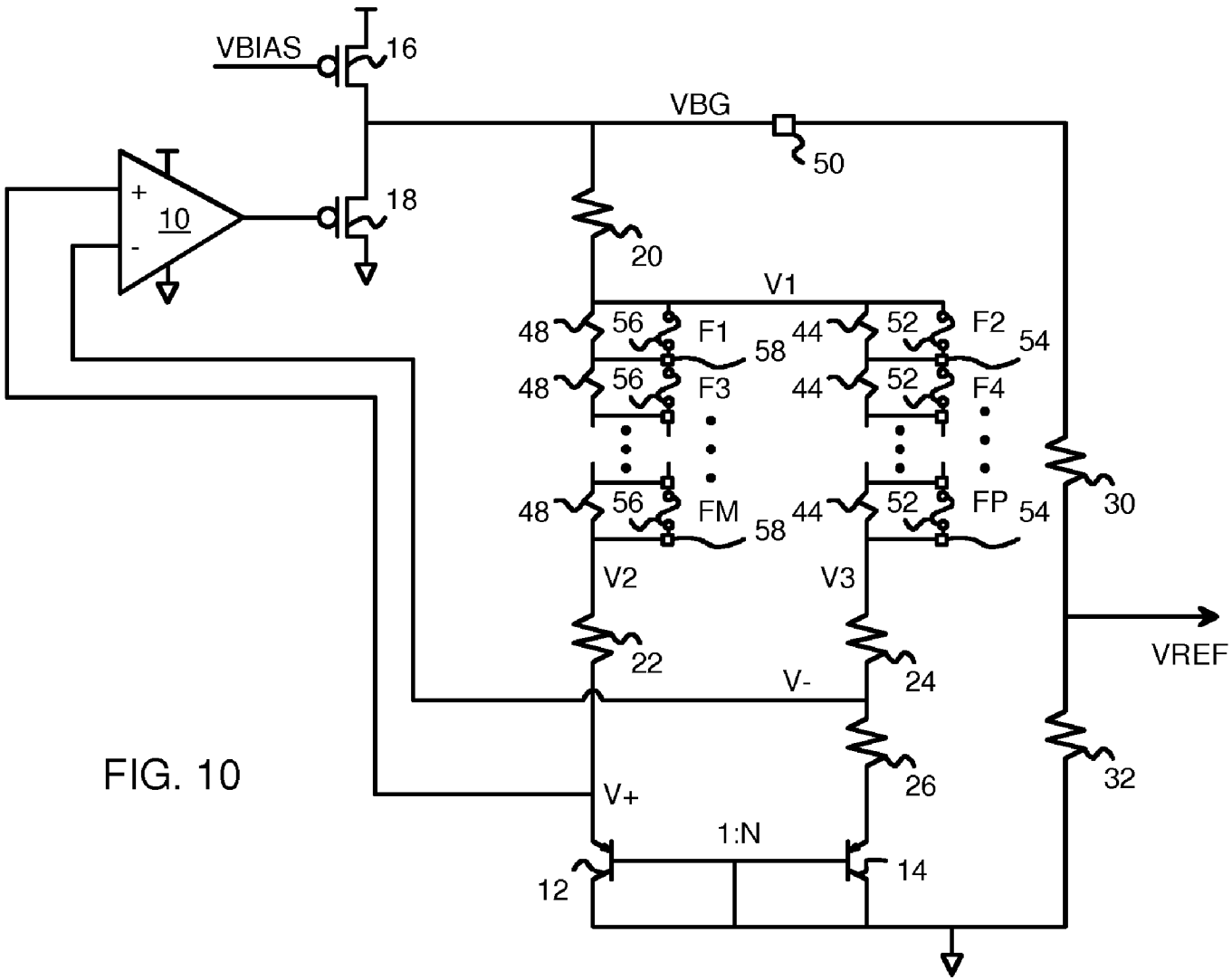
FIG. 10 is an alternate bandgap reference circuit with current trimming for both trimming-up and trimming-down.

FIG. 10 is an alternate bandgap reference circuit with current trimming for both trimming-up and trimming-down. The circuit of FIG. 10 is similar to the circuits of FIG. 5 and FIG. 1 and operates in a similar manner. However, rather than trim R1 and R4, R2 is adjusted in the two branches by adjusting parallel resistors 22, 24.

Ideally, the current in both branches is equal, and the resistances of parallel resistors 22, 24 are also equal. However, offsets in the op amp can skew these currents and make them non-equal, affecting Vbg and Vref.

Sensing resistor 20 drives node V1 from Vbg. The current through sensing resistor 20 is split into two branches at node V1. The left current branch passes through trimming-down resistors 48 and parallel resistor 22 to node V+ and PNP transistor 12. The right current branch from node V1 passes through trimming-up resistors 44 and parallel resistor 24 to node V−, and then through difference resistor 26 and PNP transistor 14.

R21 is the resistance of parallel resistor 22 plus the sum of resistances of any enabled trimming-down resistors 48. R22 is the resistance of parallel resistor 24 plus the sum of resistances of any enabled trimming-up resistors 44. As FIG. 10 shows, a positive offset, $V_{offset}$, at the non-inverting input of op amp 10, V+, will cause Vbg to increase. To achieve equal inputs of op amp 10, R21 has to increase to lower the collector current of PNP transistor 12, and thus to lower the emitter voltage of PNP transistor 12, Vbe1 (=V+). Thus Vbg decreases. This is based on EQN1 and EQN2. Likewise, a positive offset at the inverting input of op amp 10, V−, will cause Vbg to decrease. To achieve equal inputs of op amp 10, R22 has to increase to lower the collector current of PNP transistor 14; thus to lower the emitter voltage of PNP transistor 14, as well as V−. Thus Vbg increases. Other offsets can be dealt with in similar way.

Each of trimming-up resistors 44 has a fuse 52 in parallel between pads 54. Probes can be applied to pads 54 around fuse 52, and a high current flowed through the probes to melt or otherwise blow fuse 52. Once fuse 52 is blown, the trimming-up resistor 44 in parallel with that fuse 52 is now in series with sensing resistor 20, and its resistance increases that of parallel resistor 24, which is R22.

Trimming-down resistors 48 are in series with parallel resistor 22. Each of trimming-down resistors 48 has a fuse 56 in parallel. Fuse 56 is between pads 58. Probes can be applied to pads 58 around fuse 56, and a high current flowed through the probes to melt or otherwise blow fuse 56. Once fuse 56 is blown, the trimming-down resistor 48 in parallel with that fuse 56 is now in series with difference resistor 26, and its resistance is added to R21.

The resistance values of trimming-up resistors 44 and trimming-down resistors 48 can be binary-weighted. For example, fuse F1 enables resistance R, fuse F3 enables resistance 2*R, fuse F5 enables resistance 4*R, . . . fuse FP enables resistance $2^{(P-1)}$*R. The trimmed resistance value R22 can be increased as more and more fuses 52 are blown. The larger R22 increases Vref.

The trimmed resistance value R21 can be increased as more and more fuses 56 are blown. The more R21 increases, the more Vref decreases. Thus Vref can be increased (trimmed up) by blowing additional fuses 52, and Vref can be decreased (trimmed down) by blowing additional fuses 56. Trimming is bi-directional and is performed as in FIG. 7.

Figure 11:
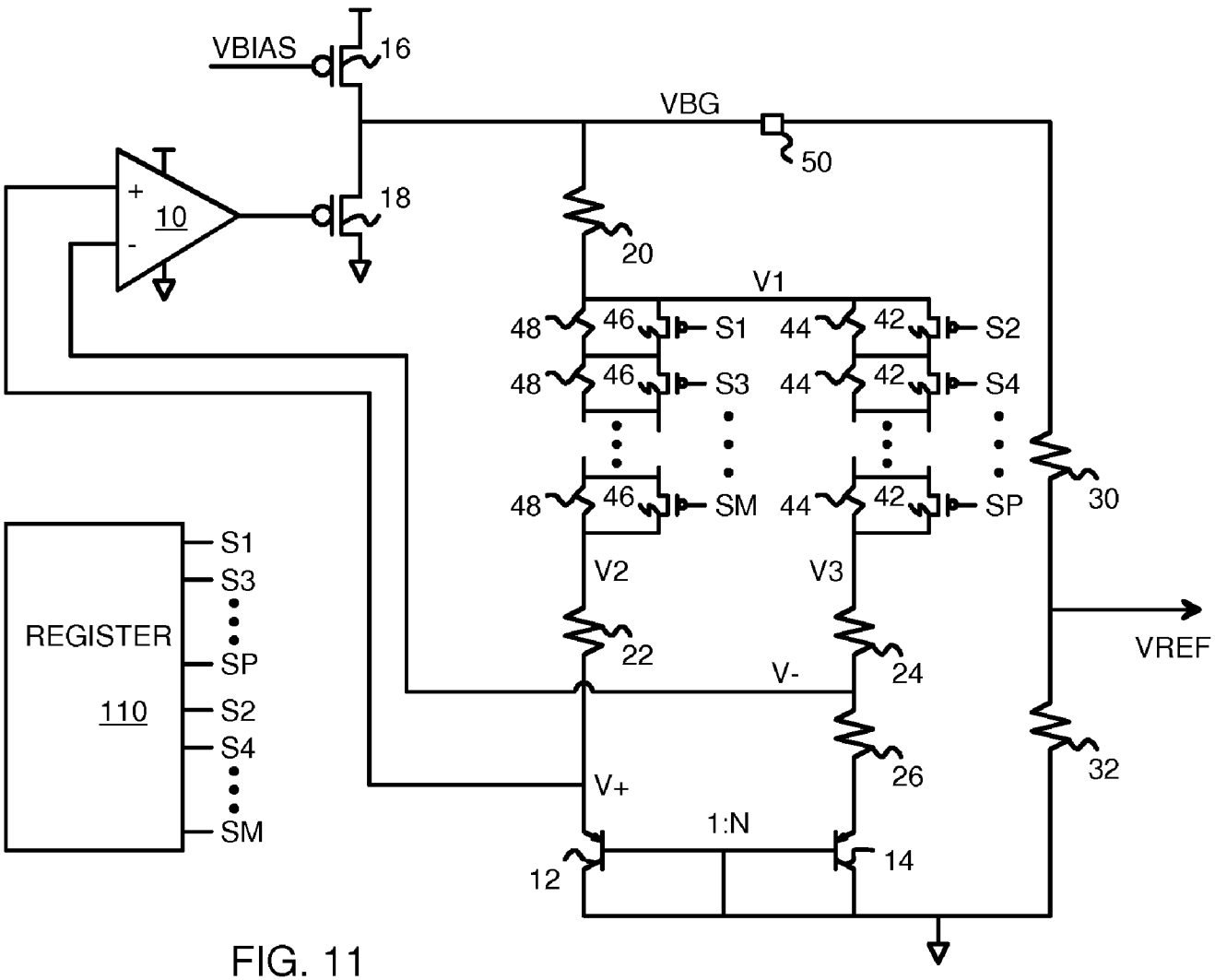
FIG. 11 is an alternate bandgap reference circuit with p-channel switches for current trimming for both trimming-up and trimming-down.

FIG. 11 is an alternate bandgap reference circuit with p-channel switches for current trimming for both trimming-up and trimming-down. The circuit of FIG. 11 is similar to the circuit of FIG. 10 and FIG. 1 and operates in a similar manner. However, rather than trim R1 and R4, R2 is adjusted in the two branches by adjusting parallel resistors 22, 24, as described for FIG. 10. Also, p-channel switches are used.

Fuses 52 are replaced by switches 42, which are in parallel with trimming-up resistors 44. The gates of p-channel transistors in switches 42 are activated to conduct when register 110 outputs a low voltage (logic zero) and to isolate when register 110 outputs a high voltage (logic 1), emulating a blown fuse.

Register 110 is initially loaded with all zeros (0000), which causes switches 42, 46 to conduct and bypass trimming-up resistors 44 and trimming-down resistors 48. During up-trimming, the digital value stored in register 110 is altered, causing some of select signals S1, S3, . . . SP to go high. The high select signal turns off one of switches 42, forcing current through one of trimming-up resistors 44, increasing resistance R22, Vbg, and Vref. Likewise, during down-trimming, the digital value stored in register 110 is altered, causing some of select signals S2, S4, . . . SM to go high. The high select signal turns off one of switches 46, forcing current through one of trimming-down resistors 48, increasing resistance R21 and decreasing Vref.

The trimmed resistance value R21 can be increased as more and more switches 46 are turned off. The more R21 increases, the more Vref decreases. Thus Vref can be increased (trimmed up) by disabling additional switches 42, and Vref can be decreased (trimmed down) by disabling additional switches 46. Trimming is bi-directional and is performed as in FIG. 9.

Alternate Embodiments

Several other embodiments are contemplated by the inventors. For example, while initial values in register 110 of all zeros have been described, other initial values could be substituted. The initial values could be adjusted as processes shift over long periods of time, or as process improvements are made or process device shrinks occur. A full transmission gate with both p-channel and n-channel transistors in parallel could be substituted, with complementary select signals applied to the p-channel and n-channel gates. Inversions could be added to the select signals, or gating or clocking could be added. N-channel transistors could replace p-channel transistors with other modifications to control signal logic. The inverting and non-inverting inputs to the op amp may be swapped, and an n-channel transistor used for p-channel generating transistor 18, or an inverter added.

While equal resistance values for parallel resistors 22, 24 have been described, these could have different resistance values, and EQN2 adjusted. More complex voltage divider networks could be substituted, and capacitors for filtering or other purposes could be added. Resistance values that are substantially equal could be within a few percent of each other, such as within 5% and still be considered equal.

The background of the invention section may contain background information about the problem or environment of the invention rather than describe prior art by others. Thus inclusion of material in the background section is not an admission of prior art by the Applicant.

Any methods or processes described herein are machine-implemented or computer-implemented and are intended to be performed by machine, computer, or other device and are not intended to be performed solely by humans without such machine assistance. Tangible results generated may include reports or other machine-generated displays on display devices such as computer monitors, projection devices, audio-generating devices, and related media devices, and may include hardcopy printouts that are also machine-generated. Computer control of other machines is another tangible result.

Any advantages and benefits described may not apply to all embodiments of the invention. When the word "means" is recited in a claim element, Applicant intends for the claim element to fall under 35 USC Sect. 112, paragraph 6. Often a label of one or more words precedes the word "means". The word or words preceding the word "means" is a label intended to ease referencing of claim elements and is not intended to convey a structural limitation. Such means-plus-function claims are intended to cover not only the structures described herein for performing the function and their structural equivalents, but also equivalent structures. For example, although a nail and a screw have different structures, they are equivalent structures since they both perform the function of fastening. Claims that do not use the word "means" are not intended to fall under 35 USC Sect. 112, paragraph 6. Signals are typically electronic signals, but may be optical signals such as can be carried over a fiber optic line.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

We claim:

1. A bi-directional trimming reference circuit comprising:

an op amp having a first input and a second input, the op amp generating an op-amp output from a voltage difference between the first input and the second input;

a generating transistor, having a gate receiving the op-amp output and generating a bandgap reference voltage on a bandgap reference node in response to the op-amp output;

a plurality of trimming-up resistor cells connected in series between the bandgap reference node and a first node, the plurality of trimming-up resistor cells having a first variable resistance that is determined by programming;

a sensing resistor connected between the first node and a splitting node;

a first parallel resistor connected between the splitting node and the first input to the op amp;

a first bipolar transistor connected to the first input of the op amp;

a second parallel resistor connected between the splitting node and the second input to the op amp;

a difference resistor connected between the second input to the op amp and a second node;

a second bipolar transistor connected to the second node, and having a base connected to a base of the first bipolar transistor;

a plurality of trimming-down resistor cells connected in series between the bandgap reference node and a third node, the plurality of trimming-down resistor cells having a second variable resistance that is determined by programming; and an output resistor connected between the third node and a reference output node.

2. The bi-directional trimming reference circuit of claim 1 wherein each resistor cell in the plurality of trimming-up resistor cells and in the plurality of trimming-down resistor cells comprises:

a trim resistor connected between a cell input node and a cell output node;

a trim bypass element connected between the cell input node and the cell output node;

wherein the trim bypass element is programmable to bypass current around the trim resistor in a shorted state, and to force current through the trim resistor in an open state;

wherein a trim resistance value of the trim resistor is added to a total trim resistance when the trim bypass element is in the open state, and the trim resistance value of the trim resistor is not added to the total trim resistance when the trim bypass element is in the shorted state.

3. The bi-directional trimming reference circuit of claim 2 wherein the trim resistance value of the trim resistor is in a binary-weighted series of resistance values, whereby the plurality of trimming-up resistor cells and the plurality of trimming-down resistor cells each comprise a series of binary-weighted trim resistors.

4. The bi-directional trimming reference circuit of claim 2 wherein the total trim resistance of the plurality of trimming-up resistor cells is the first variable resistance that varies with programming of the trim bypass element in the plurality of trimming-up resistor cells;

wherein the total trim resistance of the plurality of trimming-up resistor cells is selectably increased by programming during a trimming process to increase the bandgap reference voltage and a reference voltage on the reference output node;

wherein the total trim resistance of the plurality of trimming-down resistor cells is the second variable resistance that varies with programming of the trim bypass element in the plurality of trimming-down resistor cells;

wherein the total trim resistance of the plurality of trimming-down resistor cells is selectably increased by programming during a trimming process to decrease the reference voltage on the reference output node;

whereby the reference voltage is able to be increased or decreased during the trimming process.

5. The bi-directional trimming reference circuit of claim 4 wherein the trim bypass element in each resistor cell comprises a trim transistor having a channel connected between the cell input node and the cell output node and a gate controlled by a select signal.

6. The bi-directional trimming reference circuit of claim 5 wherein the trim transistor is a p-channel transistor.

7. The bi-directional trimming reference circuit of claim 5 further comprising:

a register for storing a first value that drives a plurality of the select signal applied to the gate of the trim transistor for all resistor cells in the plurality of trimming-up resistor cells, and for storing a second value that drives a plurality of the select signal applied to the gate of the trim transistor for all resistor cells in the plurality of trimming-down resistor cells, wherein the first value is programmable increased to programmably increase the reference voltage;

wherein the second value is programmable increased to programmably decrease the reference voltage.

8. The bi-directional trimming reference circuit of claim 4 wherein the trim bypass element in each resistor cell comprises:

a fuse; and a cell pad, wherein the cell pad is for accepting a test probe during the trimming process.

9. The bi-directional trimming reference circuit of claim 8 further comprising:

a pad connected to the reference output node, for accepting a test probe during the trimming process to measure the reference voltage during the trimming process.

10. The bi-directional trimming reference circuit of claim 9 further comprising:

a bandgap reference node pad connected to the bandgap reference node, accepting a test probe during the trimming process to measure the bandgap reference voltage during the trimming process and for applying current to program the fuse for a top resistor cell in the plurality of trimming-up resistor cells and for applying current to program the fuse for a top resistor cell in the plurality of trimming-down resistor cells, wherein the top resistor cell has a cell input node connected to the bandgap reference node, wherein the cell pad is connected to the cell output node for each resistor cell, wherein the bandgap reference node pad is shared for use by the top resistor cell in the plurality of trimming-up resistor cells and for use by the top resistor cell in the plurality of trimming-down resistor cells, whereby the bandgap reference node pad is shared.

11. The bi-directional trimming reference circuit of claim 4 wherein the first bipolar transistor is a PNP transistor having an emitter connected to the first input to the op amp and a collector connected to a ground;

wherein the second bipolar transistor is a PNP transistor having an emitter connected to the second node and a collector connected to the ground.

12. The bi-directional trimming reference circuit of claim 11 wherein the second bipolar transistor is substantially N times larger than the first bipolar transistor, wherein N is a whole number.

13. The bi-directional trimming reference circuit of claim 11 wherein the base of the first bipolar transistor and the base of the second bipolar transistor are connected together and to the ground.

14. The bi-directional trimming reference circuit of claim 11 further comprising:

a sink resistor connected between the reference output node and the ground.

15. The bi-directional trimming reference circuit of claim 11 wherein the first parallel resistor and the second parallel resistor have a substantially same resistance value, wherein the substantially same resistance value is with 5%.

16. The bi-directional trimming reference circuit of claim 11 wherein the generating transistor is a p-channel transistor having a drain connected to the ground and a source connected to the bandgap reference node;

further comprising:

a p-channel bias transistor having a gate receiving a bias voltage, a source connected to a power supply, and a drain connected to the bandgap reference node.

17. A trimming bandgap reference generator comprising:

an op amp having a first input and a second input and an op-amp output;

a generating transistor driving a bandgap reference node in response to a gate receiving the op-amp output;

a sensing resistor connected between the bandgap reference node an a splitting node;

a plurality of trimming-up resistor cells connected in series between the splitting node and a third node, the plurality of trimming-up resistor cells having a first resistance value that is determined by trimming;

a first parallel resistor connected between the second node and the first input;

a first PNP transistor having an emitter connected to the first input and a base connected to a ground, and a collector connected to the ground;

a plurality of trimming-down resistor cells connected in series between the splitting node and a second node, the plurality of trimming-down resistor cells having a second resistance value that is determined by trimming;

a second parallel resistor connected between the third node and the second input;

a difference resistor connected between the second input and a fourth node; and a second PNP transistor having an emitter connected to the fourth node and a base connected to the ground, and a collector connected to the ground;

wherein each resistor cell in the plurality of trimming-up resistor cells comprises:

a trim resistor connected between a cell input node and a cell output node;

a trim bypass element connected between the cell input node and the cell output node;

wherein the trim bypass element is programmable to bypass current around the trim resistor in a shorted state, and is programmable to force current through the trim resistor in an open state;

wherein a trim resistance value of the trim resistor is added to the first resistance value when the trim bypass element is in the open state, and the trim resistance value of the trim resistor is not added to the first resistance value when the trim bypass element is in the shorted state;

wherein each resistor cell in the plurality of trimming-down resistor cells comprises:

a trim resistor connected between a cell input node and a cell output node;

a trim bypass element connected between the cell input node and the cell output node;

wherein the trim bypass element is programmable to bypass current around the trim resistor in a shorted state, and is programmable to force current through the trim resistor in an open state;

wherein a trim resistance value of the trim resistor is added to the second resistance value when the trim bypass element is in the open state, and the trim resistance value of the trim resistor is not added to the second resistance value when the trim bypass element is in the shorted state;

wherein the trim bypass element comprises a fuse or a transistor, whereby a bandgap reference voltage on the bandgap reference node is increasable during trimming by increasing the first resistance value by programming trim bypass elements in the plurality of trimming-up resistor cells into the open state, and is decreasable during trimming by increasing the second resistance value by programming trim bypass elements in the plurality of trimming-down resistor cells into the open state.

18. The trimming bandgap reference generator of claim 17 further comprising:

an output resistor connected between the bandgap reference node and a reference output node;

a sink resistor connected between the reference output node and the ground.

19. A trim reference circuit comprising:

operational amplifier means for generating an output by comparing a first input to a second input;

generating transistor means for generating a bandgap reference voltage on a bandgap reference node in response to the output from the operational amplifier means;

a sensing resistor connected between the bandgap reference node an a splitting node;

first variable resistor means, connected between the splitting node and a second node, for generating a first resistance value that is varied by trimming;

a first parallel resistor connected between the second node and the first input;

first PNP transistor means for sinking current from an emitter connected to the first input in response to a base connected to a ground, and having a collector connected to the ground;

second variable resistor means, connected between the splitting node and a third node, for generating a second resistance value that is varied by trimming;

a second parallel resistor connected between the third node and the second input;

a difference resistor connected between the second input and a fourth node; and second PNP transistor means for sinking current from an emitter connected to the fourth node in response to a base connected to the ground, and having a collector connected to the ground, program means for adjusting a bandgap reference voltage on the bandgap reference node during trimming by varying the first resistance value of the first variable resistor means and by varying the second resistance value of the second variable resistor means;

wherein the program means further comprises:

trim-up means for blowing fuses or for disabling transistors that bypass binary-weighted resistors in the first variable resistor means to increase the bandgap reference voltage; and trim-down means for blowing fuses or for disabling transistors that bypass binary-weighted resistors in the second variable resistor means to decrease the bandgap reference voltage.

20. The trim reference circuit of claim 19 wherein the first variable resistor means comprises a plurality of first trim resistors connected in series with each other;

a plurality of bypass elements, each bypass element connected in parallel with one of the first trim resistors in the plurality of first trim resistors;

wherein each bypass element in the plurality of bypass elements has an open state and a closed state;

first programmable means for programming the plurality of bypass elements into open and closed states to adjust the first resistance value;

wherein the second variable resistor means comprises a plurality of second trim resistors connected in series with each other;

a plurality of bypass elements, each bypass element connected in parallel with one of the second trim resistors in the plurality of second trim resistors;

wherein each bypass element in the plurality of bypass elements has an open state and a closed state;

second programmable means for programming the plurality of bypass elements into open and closed states to adjust the second resistance value;

wherein each bypass element in the plurality of bypass elements comprises a fuse that is blown into the open state, or a trim transistor having a gate receiving a control signal that activates the trim transistor to conduct current and to isolate.

* * * * *